US007671757B2

(12) United States Patent
Mathews, Jr. et al.

(10) Patent No.: US 7,671,757 B2
(45) Date of Patent: Mar. 2, 2010

(54) METHOD AND APPARATUS FOR DETECTING MISALIGNMENT OF TRAIN INSPECTION SYSTEMS

(75) Inventors: Harry Kirk Mathews, Jr., Clifton Park, NY (US); Benjamin Paul Church, Blue Springs, MI (US)

(73) Assignee: General Electric Company, Schenectady, NY (US)

( * ) Notice: Subject to any disclaimer, the term of this patent is extended or adjusted under 35 U.S.C. 154(b) by 324 days.

(21) Appl. No.: 11/758,881

(22) Filed: Jun. 6, 2007

(65) Prior Publication Data

US 2008/0303656 A1 Dec. 11, 2008

(51) Int. Cl.
*G08B 21/00* (2006.01)
*G08B 17/00* (2006.01)
*B61L 25/02* (2006.01)

(52) U.S. Cl. ..... 340/686.1; 340/686.2; 340/584; 246/124

(58) Field of Classification Search ..... None
See application file for complete search history.

(56) References Cited

U.S. PATENT DOCUMENTS

| | | | | |
|---|---|---|---|---|
| 3,812,343 | A | 5/1974 | Gallagher et al. | |
| 3,872,456 | A | 3/1975 | Glazar | |
| 4,443,119 | A | 4/1984 | Snider, Jr. et al. | |
| 4,501,006 | A | 2/1985 | Korenberg | |
| 4,659,043 | A | 4/1987 | Gallagher | |
| 4,974,797 | A | 12/1990 | Myers et al. | |
| 5,100,243 | A | 3/1992 | Grosskopf et al. | |
| 5,429,329 | A * | 7/1995 | Wallace et al. | 246/166 |
| 5,660,470 | A | 8/1997 | Mench | |
| 5,677,533 | A * | 10/1997 | Yaktine et al. | 250/342 |
| 6,523,411 | B1 | 2/2003 | Mian et al. | |
| 6,663,053 | B1 * | 12/2003 | Shams | 246/249 |
| 7,415,771 | B2 * | 8/2008 | Harrill | 33/264 |
| 2008/0228427 | A1 * | 9/2008 | Church | 702/135 |
| 2008/0288170 | A1 * | 11/2008 | Ruggiero | 702/1 |

FOREIGN PATENT DOCUMENTS

DE 4325018 A1 3/1994

OTHER PUBLICATIONS

Knoll, et al., "Entwicklung Eines Checkpointprototypen bei der OEBB Infrastruktur Betrieb AG," Signal + Draht, Telzlaff Verlag GmbH, Darmstadt, DE, Jul. 1, 2006, pp. 10-14, XP001244502, ISSN: 0037-4997.

Wolfberg, et al., "Der Fracas-Prozess—Felddatenerfassung und Verfuegbarkeitsoptimierung," Signal + Draht, Telzlaff Verlag GmbH, Darmstadt, DE, vol. 93, No. 10, Oct. 1, 2001, pp. 25-29, XP001082215, ISSN: 0037-4997.

PCT International Search Report, Int'l App. No. PCT/US2008/061897 (Apr. 29, 2008).

* cited by examiner

*Primary Examiner*—Julie Lieu
(74) *Attorney, Agent, or Firm*—John A. Kramer, Esq.; Armstrong Teasdale LLP

(57) ABSTRACT

A method and system to detect misalignment of sensors used in train inspection systems are provided. The method includes receiving inputs from a train inspection sensor that is coupled to a railroad track, determining a position of the train inspection sensor using a motion detector, and identifying the inputs received from the train inspection sensor as at least one of acceptable or not acceptable based on the determined position of the train inspection sensor.

17 Claims, 4 Drawing Sheets

METHOD AND APPARATUS FOR DETECTING MISALIGNMENT OF TRAIN INSPECTION SYSTEMS

BACKGROUND OF THE INVENTION

This invention relates generally to automated railroad operation, and more particularly, to a method and apparatus for determining the alignment of a train inspection sensor.

Modern railroad car wheel bearings are permanently lubricated sealed units designed to last for the life of the car. However, during operation, excess friction between the axle and the bearing may produce excess heat, resulting in a condition referred to as a hot box. Moreover, when a bearing begins to operate above a predetermined temperature, continued movement of the car may cause the bearing to seize. As a result, the railroad service industry has devoted significant resources to building detectors that automatically check passing trains for hot boxes and/or hot wheels. Such detectors are generally spaced along railroad tracks at about twenty to fifty mile intervals along main-line track, and many are necessarily located in remote places.

At least one known detector includes a bearing temperature sensing unit for focusing infrared radiation that is transmitted from passing railcar bearings onto an infrared sensor. The bearing temperature sensing unit is coupled to electrical circuitry which develops a signal that is representative of the journal temperature. One bearing temperature sensing unit is placed along one rail of the tracks and a second bearing temperature sensing unit is placed along the other rail of a set of tracks, so that both sides of a train can be monitored. Electrical lines connect these trackside bearing temperature sensing units to processing circuitry which is generally located in a "bungalow" close to the tracks. The primary use of the detector is to detect overheated bearings and alert the train operator to prevent possible damage to the railcar bearings.

In operation, if the hot box detector detects a hot box condition, a signal that indicates that the temperature of a wheel journal exceeds a predetermined value is then transmitted. Specifically, when a hot box condition is detected, i.e. the signal triggers an alarm, the train car is stopped to manually inspect the suspect wheel bearing or hot box.

The effectiveness of the hot box detector system depends on various factors, including the alignment of the bearing temperature sensing units. For example, a misaligned bearing temperature sensing unit may sense the infrared energy from the brakes instead of the bearings. If this signal generated from the brakes exceeds the predetermined hot bearing alarm level, the hot box detector will falsely alarm, thereby causing an operator to stop the train and manually inspect the suspect wheel bearing or hot box. Such misalignment of the bearing temperature sensing unit may arise from several causes, such as, but not limited to, being struck by a passing train, being struck by a passing vehicle, being misaligned as a result of the weather, and/or through vandalism. As a result, misalignment of the bearing temperature sensing unit misalignment may lead to false alarms thus causing a false stop to occur.

BRIEF DESCRIPTION OF THE INVENTION

In one embodiment, a method to detect misalignment of sensors used in train inspection systems is provided. The method includes receiving inputs from a train inspection sensor that is coupled to a railroad track, determining a position of the train inspection sensor using a motion detector, and identifying the inputs received from the train inspection sensor as at least one of acceptable or not acceptable based on the determined position of the train inspection sensor.

In another embodiment, a system for use in detecting misalignment of sensors used in train inspection systems is provided. The system includes at least one train inspection sensor coupled to a railroad track, a motion detector coupled to the at least one train inspection sensor, and a detecting unit coupled to the at least one train inspection sensor and to the motion detector. The detecting unit is configured to: receive inputs from the at least one train inspection sensor, determine a position of the at least one train inspection sensor using inputs received from the motion detector, and identify the received inputs as at least one of acceptable or not acceptable based on the determined position of the at least one train inspection sensors.

DETAILED DESCRIPTION OF THE INVENTION

Many specific details of certain embodiments of the invention are set forth in the following description in order to provide a thorough understanding of such embodiments. One skilled in the art, however, will understand that the present invention may have additional embodiments, or that the present invention may be practiced without several of the details described in the following description.

Figure 1:
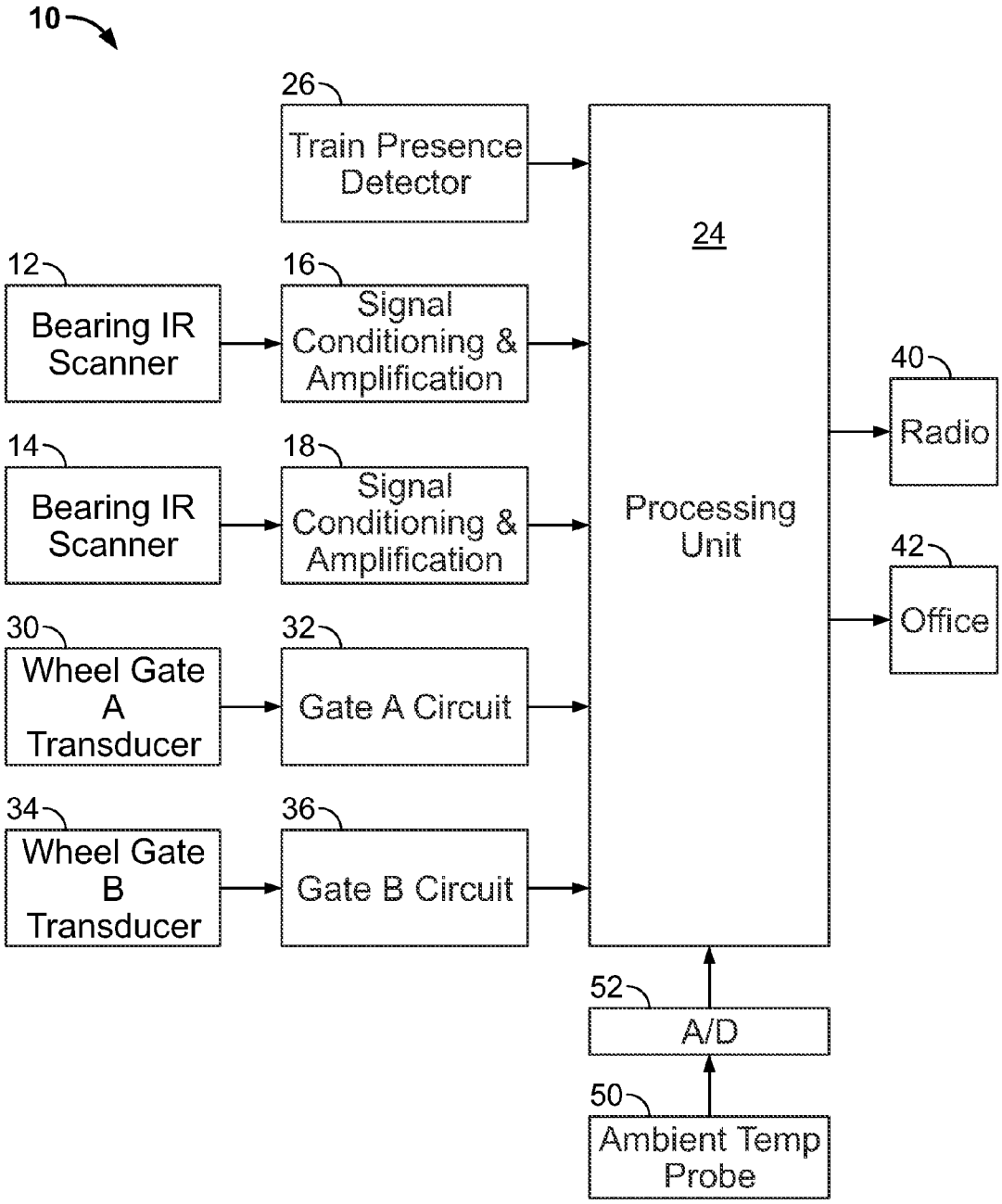
FIG. 1 is a schematic illustration of an exemplary hot box detection system.

FIG. 1 is a schematic illustration of an exemplary apparatus, or hot box detection system 10 for detecting overheated railroad journal bearings. System 10 includes a first infrared bearing temperature sensing unit 12 and a second infrared bearing temperature sensing unit 14. In the exemplary embodiment, infrared bearing temperature sensing units 12 and 14 each include a lens (not shown) for focusing impinging infrared onto a pyroelectric cell (not shown) or other suitable infrared bearing temperature sensing unit or sensor. In the exemplary embodiment, the lens is a germanium lens that focuses and transmits only the far infrared portion of the spectrum. During operation, the pyroelectric cell, which may be fabricated from $LiTaO_3$, converts the impinging infrared radiation to an analog electrical voltage having a magnitude that is directly proportional to the infrared radiation of passing objects.

System 10 also includes a first signal conditioning and amplification unit 16 that is coupled to and receives a signal from first bearing temperature sensing unit 12. System 10 also includes second signal conditioning and amplification unit 18 that is coupled to and receives a signal from second bearing temperature sensing unit 14. Each of signal condition units 16 and 18 are configured to condition and amplify the voltage component of the signal transmitted from each respective bearing temperature sensing unit 12 and 14, thereby measuring the voltage response of the bearing temperature sensing units to changes in the amount of infrared energy. In the exemplary embodiment, the output signals of each of bearing temperature sensing units 12 and 14 exhibit a linear response to passing objects traveling at speeds in the range of approximately 5 miles per hour to approximately 150 miles per hour.

The analog signal generated by each respective signal condition unit 16 and 18 are transmitted to a processing unit 24 which in the exemplary embodiment is a microcontroller. Processing unit 24 includes an analog to digital converter (A/D converter) (not shown), which converts the analog signal to a digital signal. All further signal processing and all instructions are performed digitally. In an alternative embodiment, system 10 does not include processing unit 24, but rather includes a detecting unit, such as an analog comparator, that enables system 10 to function as described herein.

In the exemplary embodiment, processing unit 24 includes all of the circuits required for fetching, interpreting, and executing instructions that are stored in memory, whether volatile or nonvolatile. Processing unit 24 further includes a program counter, an instruction decoder, an arithmetic logic unit, and accumulators. Computer programs, or software, are stored in memory storage units. A suitable memory storage unit used in the preferred embodiment is an electrically erasable programmable read only memory (hereinafter "EEPROM"). Moreover, it is understood that other types of memory units could be utilized, such as simple read only memory (ROM), or programmable read only memory (PROM), or, if the ability to reprogram the ROM is desirable, erasable programmable read only memory (EPROM), which are conventionally erased by exposure to ultraviolet light or FLASH memory.

System 10 also includes a train presence detector 26 which is configured to determine the presence of a train approaching system 10. In the exemplary embodiment, the processing unit 24 will energize or de-energize a shutter (not shown) that is utilized to cover and protect the IR sensor (not shown) contained in the bearing temperature sensing units 12 and 14 based upon the state of the train presence detector 26.

System 10 further includes a first wheel gate transducer 30 that is coupled on a railroad track (not shown) and connected to processing unit 24 via a first gate circuit 32. System 10 also includes a second wheel gate transducer 34 that is connected to processing unit 24 via a second gate circuit 36. Such transducers, referred to hereinafter as the gate on and gate off transducers respectively, typically are spaced apart longitudinally along the rails a distance of about 24 inches. The processing unit 24 determines the IR samples associated with a passing bearing using the gate on and gate off pulses generated by these transducers.

The length of time that the wheel component to be scanned is in the scanning zone will be referred to as the scanning period. The scanning period of the system 10 is sized to accommodate a range of rolling stock wheel sizes varying up to approximately 42 inches and for different train speeds. Accordingly, the wheel gate transducers 30 and 34 each transmit a signal to processing unit 24 when a train wheel passes over it. More specifically, each wheel gate transducer 30, 34 generates an analog signal that is transmitted to a respective gate circuit 32, 36 which converts the analog signal to a digital signal which is then transmitted to processing unit 24 to generate an interrupt signal.

In the exemplary embodiment, system 10 is configured to transmit a warning indication that is generated by processing unit 24. For example, the radio unit may be configured to transmit a signal to a radio unit 40 that is mounted in a passing train to alert the train operator that a hot box alarm has been generated. Moreover, system 10 may transmit information to a remote office 42 including train summary data, detailed train data, bearing profiles, warnings and alarm information.

Figure 2:
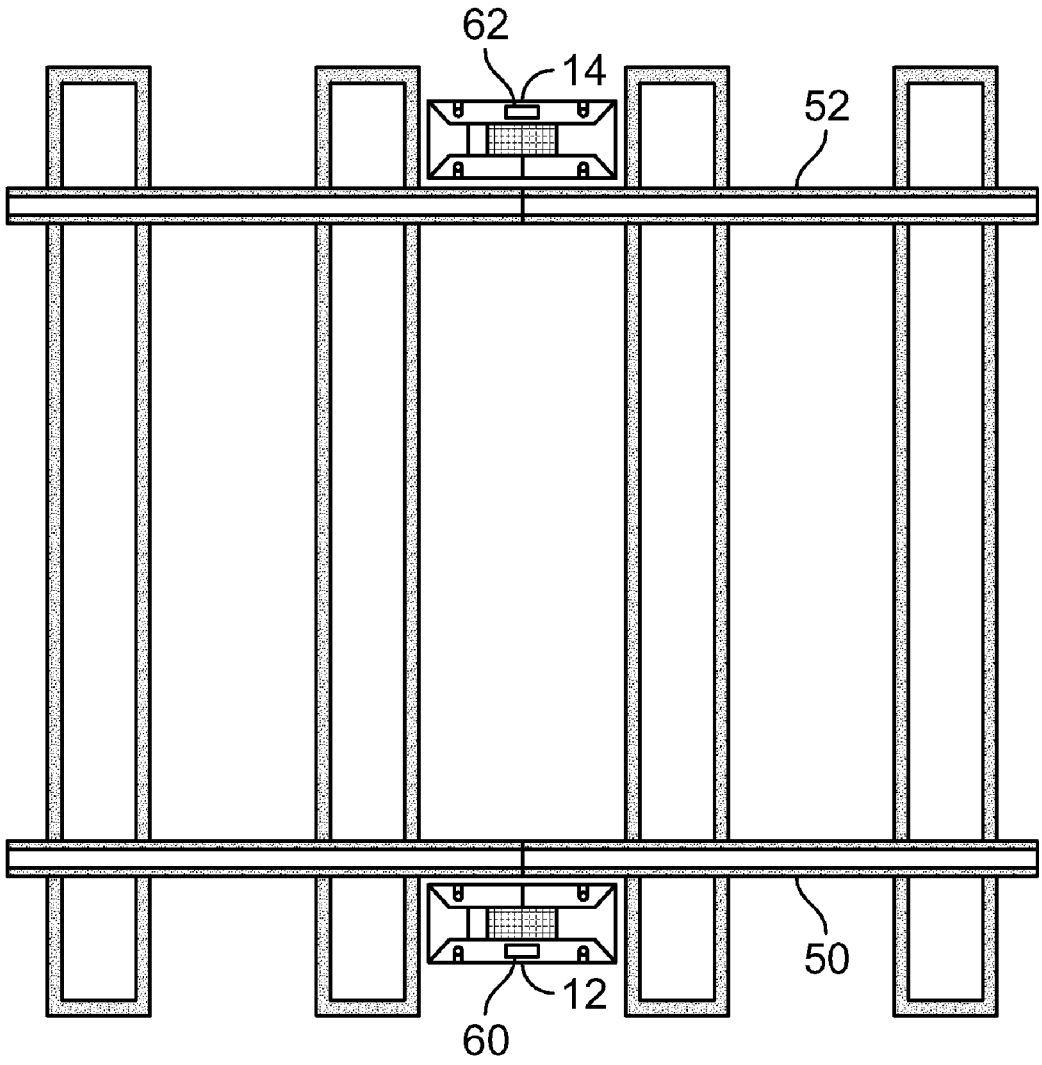
FIG. 2 is a top view of a plurality of exemplary bearing scanners each coupled proximate to a respective railroad track.

FIG. 2 is a top view of first bearing temperature sensing unit 12 that is coupled to a first railroad track 50 and second bearing temperature sensing unit 14 that is coupled to a second railroad track 52. As discussed above, the first bearing temperature sensing unit 12 is placed along one rail 50 of the tracks and the second bearing temperature sensing unit 14 is placed along the other rail 52 of a set of tracks, so that both sides of a train can be monitored. Electrical lines connect these trackside bearing temperature sensing units 12 and 14 to processing circuitry (shown in FIG. 1) which is generally located in a "bungalow" close to the tracks. For example, in one embodiment, sensing units 12 and/or 14 are wirelessly coupled to the tracks.

However, as discussed above, conditions such misalignment of the first and/or second bearing temperature sensing units 12, 14 may cause a signal indicative of a hot box condition to be transmitted when in fact a hot box condition has not occurred. To reduce and/or eliminate false alarms caused by signals from misaligned bearing temperature sensing units 12 and 14 from being processed by processing unit 24, system 10 also includes at least one motion detector that is utilized to determine if the bearing temperature sensing units 12 and/or 14 are properly aligned and positioned to monitor the train bearings passing by the Hot Box Detection System 10. Position as used herein is defined as the relative position, translation, orientation, or rotation of the bearing temperature sensors with respect to the rail of the railroad track and the bearing scan target area.

Figure 3:
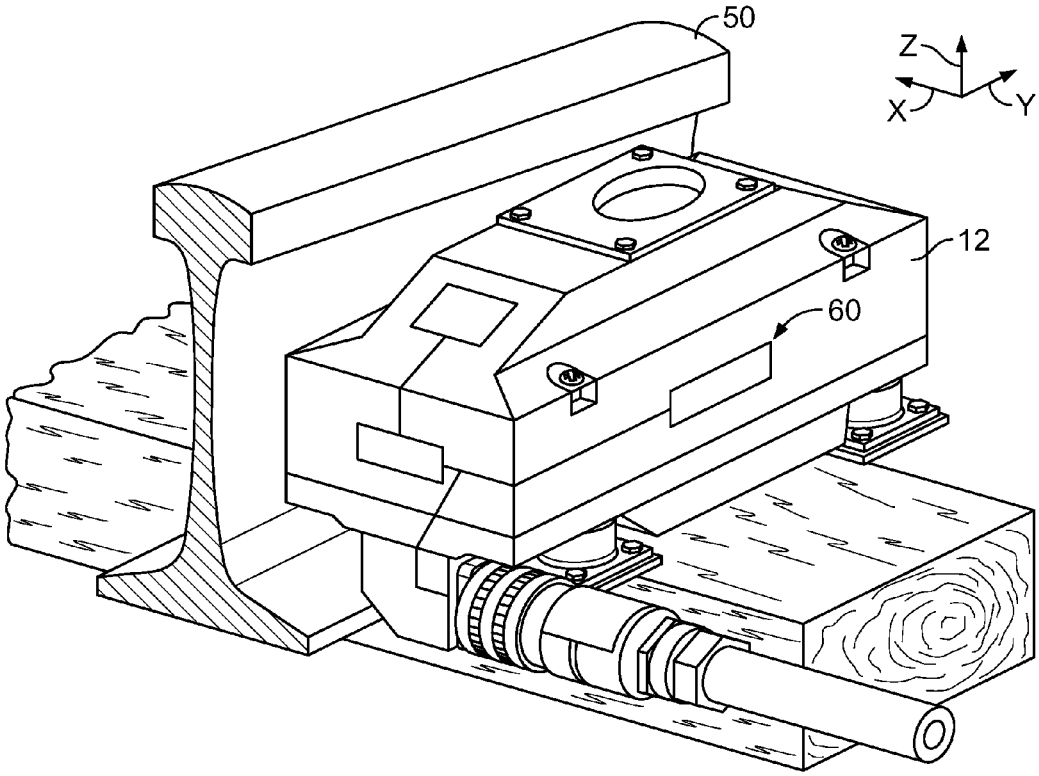
FIG. 3 is a perspective view of an exemplary bearing scanner shown in FIG. 2.
Figure 4:
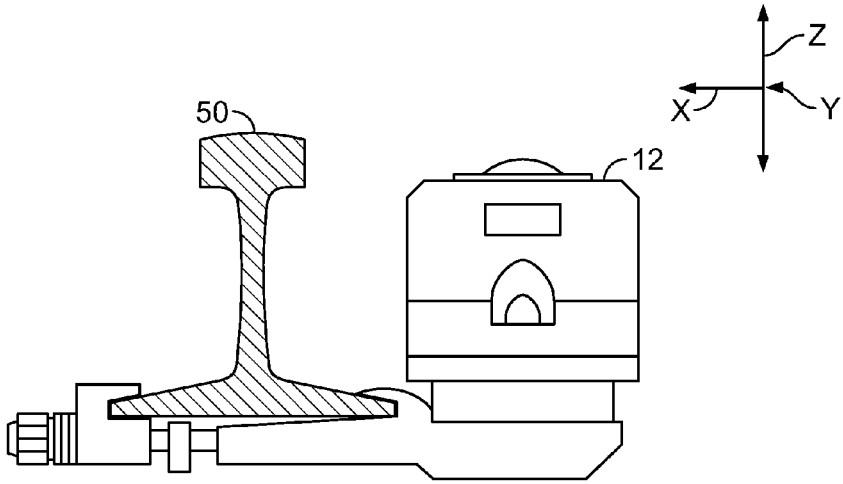
FIG. 4 is an end view of the exemplary bearing scanner shown in FIG. 3.

For example, FIG. 3 is a perspective view of IR bearing scanner 12 coupled to rail 50, and FIG. 4 is an end view of bearing IR scanner 12 coupled to rail 50. In the exemplary embodiment, system 10 includes a first motion detector 60 that is coupled to bearing temperature sensing unit 12 and a second motion detector 62 that is coupled to bearing temperature sensing unit 14. In use, the first and second motion detectors 60 and 62 are each configured to provide positional information to system 10 to enable system 10 to determine if either the first bearing temperature sensing unit 12 and/or the second bearing temperature sensing unit 14 is properly positioned with respect to the rail of the railroad tracks 50 and 52.

In the exemplary embodiment, the first and second motion detectors 60 and 62 are implemented utilizing accelerometers. In one embodiment, each of accelerometers 60 and 62 are two-axis accelerometers that are configured to determine the position of each respective bearing temperature sensing unit 12 and 14 in an x-direction and a y-direction as shown in FIGS. 3 and 4. In another embodiment, each of accelerometers 60 and 62 are one-, two-, or three-axis accelerometers that are configured to function as a tilt sensor and are used to determine the position of each respective bearing temperature sensing unit 12 and 14 in an x-direction, a y-direction, and a z-direction as shown in FIG. 3.

Figure 5:
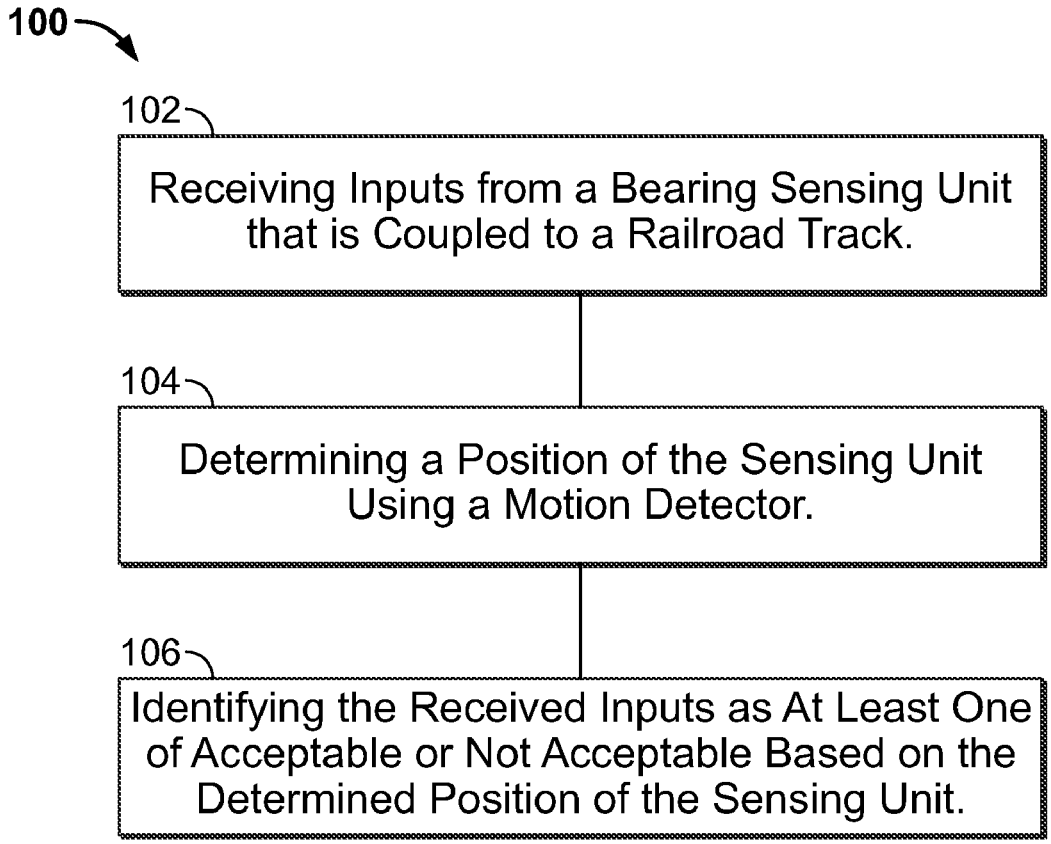
FIG. 5 is a flowchart illustrating an exemplary method for receiving false train stops.

FIG. 5 is a flowchart illustrating an exemplary method 100 for reducing false train stops using hot box detection system 10. Method 100 includes receiving 102 inputs from a bearing temperature sensing unit 12/14 that is coupled to a rail of the railroad track 50/52, determining 104 a position of the bearing temperature sensing unit 12/14 using a motion detector 60/62, and identifying 106 the received inputs as at least one of acceptable or not acceptable based on the determined position of the bearing temperature sensing unit 12/14.

During operation, hot box detection system 10 is selectively operable in a calibration mode and a monitoring mode. More specifically, hot box detection system 10 is configured to first determine a baseline position for at least one of bearing temperature sensing units 12 and/or 14. The baseline position as used herein is defined as the position of the bearing temperature sensing units 12 and 14 when the bearing temperature sensing units are properly aligned with respect to the rail and capable of transmitting accurate bearing data to the hot box detection system. The correct alignment may be determined locally be an operator using an alignment fixture to insure the bearing temperature sensing units 12 and 14 are aligned to scan within the bearing scanning volume. Once the baseline position is determined to be correct, the coordinates of the baseline position are stored in a memory, such as the memory included in processor 24. Hot box detection system 10 may then be configured to operate in the monitoring mode.

In the monitoring mode, and in the exemplary embodiment, hot box detection system 10 is programmed to continuously receive data from the motion detector 60/62 which is indicative of the current position of each bearing temperature sensing unit 12 and 14 and compare the received data to the baseline data stored within processor 24 to facilitate determining whether either bearing temperature sensing unit 12 or bearing temperature sensing unit 14 has shifted from the baseline position by a predetermined amount. In the exemplary embodiment, the predetermined amount of shift is factory set using operational data obtained from each bearing temperature sensing unit 12/14.

Additionally, if hot box detection system 10 has determined that the received inputs indicate that either bearing temperature sensing unit 12 or bearing temperature sensing unit 14 has shifted from the baseline position by the predetermined amount, processor 24 is further programmed to mark the received inputs as unacceptable indicating that either bearing temperature sensing unit 12 and/or 14 has shifted from the baseline position by the predetermined amount and to generate a maintenance alert indication when the quantity of not acceptable inputs exceeds a predetermined threshold.

For example, during typical operation, the bearing temperature sensing units 12 and 14 are subjected to normal forces, such as vibration or rail movement, that may cause the bearing temperature sensing units 12 and 14 to deviate from the baseline position. Moreover, data is continuously transmitted from accelerometers 60 and 62 to processor 24 to allow processor 24 to determine the current position of each of bearing temperature sensing units 12 and 14 and compare their current position to their respective baseline position.

However, in this case when the bearing temperature sensing units 12 and/or 14 are affected by normal movement, the data transmitted by at least one of accelerometers 60 or 62 will indicate that either bearing temperature sensing unit 12 and/or 14 has shifted from the baseline position by the predetermined amount. As discussed above, this data will be marked as unacceptable and stored within processor 24. To facilitate eliminating the generation of false maintenance alerts, system 10 is programmed to determine if the quantity of marked inputs exceeds a predetermined threshold. For example, during operation vibration may cause either bearing temperature sensing unit 12 or bearing temperature sensing unit 14 to move the predetermined amount from baseline resulting in a marked input.

Assuming the predetermined quantity of marked inputs is set to 10, i.e. 10 consecutive readings indicate that either bearing temperature sensing unit 12 or bearing temperature sensing unit 14 has shifted from the baseline position, a maintenance alert will be generated. This feature facilitates reducing or eliminating maintenance alerts from being generated based on anomalous movement readings taken during normal movement of the bearing temperature sensing units.

As will be appreciated by one skilled in the art and based on the foregoing specification, the above-described embodiments of the invention may be implemented using computer programming or engineering techniques including computer software, firmware, hardware or any combination or subset thereof, wherein the technical effect is to verify that the bearing temperature sensing units are properly aligned. Any such resulting program, having computer-readable code means, may be embodied or provided within one or more computer-readable media, thereby making a computer program product, i.e., an article of manufacture, according to the discussed embodiments of the invention. The computer readable media may be, for example, but is not limited to, a fixed (hard) drive, diskette, optical disk, magnetic tape, semiconductor memory such as read-only memory (ROM), and/or any transmitting/receiving medium such as the Internet or other communication network or link. The article of manufacture containing the computer code may be made and/or used by executing the code directly from one medium, by copying the code from one medium to another medium, or by transmitting the code over a network.

The above-described methods and systems enable automatic monitoring of the position or alignment of a train inspection sensors to determine whether the sensor is positioned properly with respect to the intended inspection target. Accordingly, the need for regular manual inspection of the sensor alignment is eliminated, thereby facilitating a reduction in costs and/or time associated with maintenance of the railroad sensors.

Exemplary embodiments of systems and methods for determining the alignment of train inspection sensors is described above in detail. The systems and methods illustrated are not limited to the specific embodiments described herein, but rather, components of the system may be utilized independently and separately from other components described herein. Further, steps described in the method may be utilized independently and separately from other steps described herein.

More specifically, described herein is a static 2 or 3-axis accelerometer that is integrated into the bearing scanner and utilized to detect static and/or dynamic measurements of gravity. During operation, the accelerometers capture the static measurements when the scanner is correctly aligned. Real-time monitoring of the static measurements from the accelerometer, allow the system to detect a mean shift indicating misalignment of the scanner. When this misaligned condition is detected maintenance alerts may then be generated.

While the invention has been described in terms of various specific embodiments, those skilled in the art will recognize that the invention can be practiced with modification within the spirit and scope of the claims.

What is claimed is:

1. A method to detect misalignment of sensors used in train inspection systems, said method comprising:

receiving inputs from a train inspection sensor that is coupled to a railroad track;

determining a position of the train inspection sensor using a motion detector;

determining a baseline position of the train inspection sensor;

monitoring the train inspection sensor to determine whether the train inspection sensor has shifted from the baseline position by a predetermined amount; and identifying the inputs received from the train inspection sensor as at least one of acceptable or not acceptable based on the determined position of the train inspection sensor.

2. A method in accordance with claim 1 further comprising marking the received inputs as unacceptable if the train inspection sensor has shifted from the baseline position by the predetermined amount.

3. A method in accordance with claim 1 further comprising determining a position of the train inspection sensor using an accelerometer.

4. A method in accordance with claim 3 wherein the train inspection sensor is a bearing temperature sensing unit, said method further comprises determining a position of the bearing temperature sensing unit using an accelerometer that is coupled to the bearing temperature sensing unit.

5. A method in accordance with claim 1 wherein receiving inputs from a train inspection sensor further comprises receiving inputs from a bearing temperature sensing unit that is coupled to the railroad track, wherein the bearing temperature sensing unit is configured to detect a temperature of a locomotive bearing journal or a rolling stock bearing journal passing an infrared bearing scanner.

6. A method in accordance with claim 1 further comprising generating a maintenance alert if the train inspection sensor has shifted from the baseline position by the predetermined amount.

7. A method in accordance with claim 1 further comprising analyzing the signal generated by the motion detector to determine if the train inspection sensor is properly aligned.

8. A method in accordance with claim 1 further comprising generating a maintenance alert indication when the quantity of not acceptable inputs exceeds a predetermined threshold.

9. A method in accordance with claim 1 further comprising determining a position of the train inspection sensor using at least one of an accelerometer and a tilt sensor.

10. A system for use in detecting misalignment of sensors used in train inspection systems, said detection system comprising:

at least one train inspection sensor coupled to a railroad track;

a motion detector coupled to said at least one train inspection sensor; and a detecting unit coupled to said at least one train inspection sensor and said motion detector, said detecting unit configured to:

receive inputs from said at least one train inspection sensor;

determine a position of said at least one train inspection sensor using inputs received from said motion detector; and identify the received inputs as at least one of acceptable or not acceptable based on whether said at least one train inspection sensor has shifted from a baseline position by a predetermined amount.

11. A system in accordance with claim 10 wherein said detecting unit is further configured to:

determine the baseline position of said at least one train inspection sensor; and monitor said at least one train inspection sensor to determine whether said at least one train inspection sensor unit has shifted from the baseline position by the predetermined amount.

12. A system in accordance with claim 10 wherein said motion detector comprises at least one accelerometer.

13. A system in accordance with claim 10 wherein said at least one train inspection sensor comprises a bearing temperature sensing unit.

14. A system in accordance with claim 13 wherein said bearing temperature sensing unit is configured to detect a temperature of locomotive bearing journals or rolling stock bearing journals passing bearing temperature sensing unit.

15. A system in accordance with claim 14 wherein said detecting unit is further configured to generate a maintenance alert if at least one of said bearing temperature sensing unit has shifted from the baseline position by the predetermined amount.

16. A system in accordance with claim 15 wherein said detecting unit is further configured to generate a maintenance alert indication when the quantity of not acceptable inputs exceeds a predetermined threshold.

17. A method to detect misalignment of sensors used in train inspection systems, said method comprising:

receiving inputs from a train inspection sensor;

determining a position of the train inspection sensor; and processing the inputs received from the train inspection sensor based on whether the position of the train inspection sensor has shifted from a baseline position by a predetermined amount.

* * * * *